US012187478B2

(12) United States Patent
Ponti

(10) Patent No.: US 12,187,478 B2
(45) Date of Patent: Jan. 7, 2025

(54) PACKAGING MACHINE WITH STATION FOR FOLDING A PREFORMED CARTON AND METHOD THEREFOR

(71) Applicant: C.M.C. S.P.A., Città di Castello (IT)

(72) Inventor: Lorenzo Ponti, Città di Castello (IT)

(73) Assignee: C.M.C. S.P.A., Città di Castello (IT)

( * ) Notice: Subject to any disclaimer, the term of this patent is extended or adjusted under 35 U.S.C. 154(b) by 57 days.

(21) Appl. No.: 17/801,317

(22) PCT Filed: Mar. 4, 2021

(86) PCT No.: PCT/IB2021/051811
§ 371 (c)(1),
(2) Date: Aug. 22, 2022

(87) PCT Pub. No.: WO2021/181220
PCT Pub. Date: Sep. 16, 2021

(65) Prior Publication Data

US 2023/0079550 A1 Mar. 16, 2023

(30) Foreign Application Priority Data

Mar. 9, 2020 (IT) ..... 102020000005002

(51) Int. Cl.
*B65B 43/10* (2006.01)
*B65B 5/02* (2006.01)
(Continued)

(52) U.S. Cl.
CPC ..... *B65B 43/10* (2013.01); *B65B 5/024* (2013.01); *B65B 59/001* (2019.05); *B65B 65/003* (2013.01)

(58) Field of Classification Search
CPC ..... B65B 43/10; B65B 5/024; B65B 59/001; B65B 65/003; B65B 43/265; B65B 43/39;
(Continued)

(56) References Cited

U.S. PATENT DOCUMENTS 2,753,770 A 7/1956 Chapman
3,241,292 A * 3/1966 Berney ..... B65B 43/39 53/382.3
(Continued)

FOREIGN PATENT DOCUMENTS

DE 102006030573 B3 10/2007
EP 0262103 A2 3/1988

OTHER PUBLICATIONS

International Search Report and the Written Opinion of the International Searching Authority, issued in corresponding International Application No. PCT/IB2021/051811, dated Apr. 28, 2021, 10 pages.

*Primary Examiner* — Thomas M Wittenschlaeger
*Assistant Examiner* — Himchan Song
(74) *Attorney, Agent, or Firm* — Rothwell, Figg, Ernst & Manbeck, P.C.

(57) ABSTRACT

A carton assembly machine for cartons (17) for packing articles (15, 15'), comprising means for feeding an unassembled carton in a feed direction, the said carton having a plurality of side flaps or panels (18, 19) whose folds are essentially parallel to the said feed direction folded onto a central portion (25) of the carton, the said machine further comprising a movable element (26) designed to move between a first position away from the route of the carton and a second position in which the said element is designed to be Inserted underneath, at an edge (27) of at least one of said side flaps or panels (19), so that the latter is raised with respect to the said central portion, in particular, in cooperation with the carton feeding.

7 Claims, 6 Drawing Sheets

(51) Int. Cl.
*B65B 59/00* (2006.01)
*B65B 65/00* (2006.01)

(58) Field of Classification Search
CPC ..... B31B 2120/004; B31B 2120/30; B31B 50/786; B31B 50/54; B31B 50/36
See application file for complete search history.

(56) References Cited

U.S. PATENT DOCUMENTS 3,296,769 A * 1/1967 Patton ..... B65B 43/39 53/76
3,309,842 A * 3/1967 Arnett ..... B65B 43/39 53/382.3
4,478,023 A * 10/1984 Becker ..... B65B 43/39 53/382.3
4,543,767 A * 10/1985 Wiseman ..... B65B 43/39 53/76
4,587,792 A * 5/1986 Hartness ..... B65B 43/39 493/183

* cited by examiner

PACKAGING MACHINE WITH STATION FOR FOLDING A PREFORMED CARTON AND METHOD THEREFOR

CROSS REFERENCE TO RELATED APPLICATION(S)

This application is a 35 U.S.C. § 371 National Phase Entry Application from PCT/IB2021/051811, filed Mar. 4, 2021, designating the United States, and also claims the benefit of Italian Application No. 102020000005002, filed Mar. 9, 2020, the disclosures of which are incorporated herein by reference in their entirety.

DESCRIPTION

The present invention relates to a packaging machinery comprising a station for folding a preformed carton and a method for folding the carton.

Cartons of various types which are suitable for packaging and effectively protecting the articles are commonly known. A particularly advantageous example from these points of view is described in application EP 3 093 246 A1 filed in the name of the Applicant. The said carton can be made to measure for the individual articles by packaging machinery equipped with means for measuring the articles to be packaged, cutting and creasing the cartons, in particular starting from a continuous cardboard web (reel or fan-folded, or produced in any commonly known way), means for creating dies, for positioning the articles on the cartons once suitably folded and glued, and for subsequent closing the said cartons around the articles. Cutting and creasing are carried out according to the measurements of the article, which are taken using appropriate means, and the article is placed on the cut and folded carton, which is subsequently closed up around the article through further folding and gluing operations. Human involvement is limited to the loading of individual articles onto a conveyor belt of the machine.

Machinery of this kind is described in applications EP 3 463 844 A1, EP 3 464 085 A1, and EP 3 464 086 A1 and in patents EP 3 464 074 B1 and EP 3 464 073 B1, filed in the name of the Applicant, which concern various solutions suitable therefor.

In particular, document EP 3 464 085 A1 describes a folding station designed expressly for forming the carton in EP 3 093 246 A1. This station must take into account the need to fold a series of reinforcement flaps against a central portion (delimited by longitudinal creases) onto which they must be glued, while a pair of side closing flaps must instead remain open to accommodate the article to package. The structure is further complicated by the presence of folding tabs (onto which the closing flaps are jointed) which must be closed and glued to the central portion to create a reinforcement. The solution adopted provides for a pair of side bars which can be moved transversely to the carton feed direction and positioned suitably with respect to the carton, according to the dimensions thereof. With a rotation, the bars cause the closure of the reinforcing flaps and of the folding tabs, without affecting the enclosing flaps, which are held open by a pair of rest elements. All this takes place, in commonly known machinery, while the carton is held in position by means of suitable holding elements and by suitably stopping the conveyor; in order for the carton to resume travel, the folding bars, the rests, and the holding elements are removed from the carton and subsequently repositioned on the next carton. This also applies to a pressing element which compresses the reinforcement flaps on the central portion, to complete the gluing.

The large number of moving parts required according to the solution described above lends the machine considerable mechanical complexity, thereby increasing plant costs and the number of components that require maintenance, and maintenance is made more complex by the size of the said components and also involves an increased energy use. Finally, the need to secure the carton in place during folding limits the productivity that can be obtained from the machine.

The aforesaid drawbacks have now been overcome, according to the present invention, by means of a carton assembly machine for cartons for packing articles, comprising means for feeding an unassembled carton in a feed direction, the said carton having a plurality of folded side flaps or panels—whose folds are essentially parallel to the said feed direction—on a central portion of the carton, the said machine further comprising a movable element designed to move between a first position away from the route of the carton and a second position in which the said element is designed to be inserted underneath, at an edge of at least one of said side flaps or panels, so that the latter is raised with respect to the said central portion, in particular, in cooperation with the carton feeding.

The movable element is designed to return to the first position to avoid unnecessary contact with the carton, and in particular to avoid coming into contact with a plurality of side flaps and/or panels which must not be raised.

According to the invention, the machine may also comprise folding means, designed to fold a plurality of flaps or panels hinged—more specifically by means of suitable longitudinal creases—onto the said central portion, before one of the said flaps or panels are raised with respect to the central.

According to a further aspect, the machinery can comprise pressing means to promote the gluing of at least part of the said flaps or panels onto the central portion, interposed between the folding means and the movable element, for example, pressing rollers.

The term 'preformed carton' (for simplicity, 'carton') means a suitably cut carton, equipped with appropriate creasing to form the packaging and which may already be glued where appropriate, as in the case of the carton described in the documents mentioned above. In particular, it means the carton at each stage of the formation thereof, in particular a die-cut form which has been creased and possibly folded.

The invention also relates to a packaging carton assembly method comprising the folding of a plurality of side flaps and/or panels over a central portion of a carton as defined above and the selective reopening of part of the said flaps or panels, in particular by means of a movable element as described above.

The invention will now be better described by illustrating preferred embodiments, provided by way of example, without limiting the scope of protection of the patent and with particular reference to the figures, in which.

Figure 3:
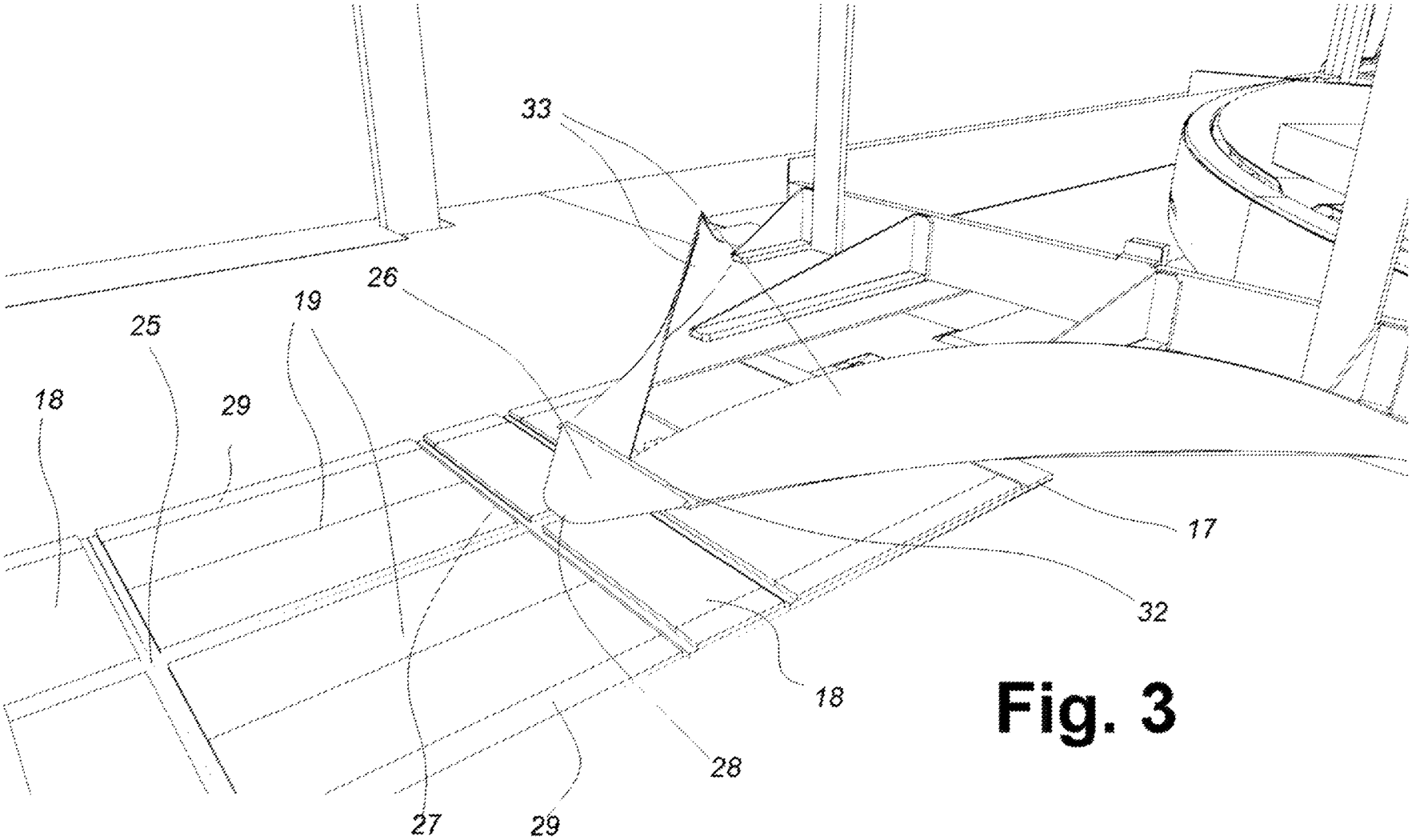
Figure 4:
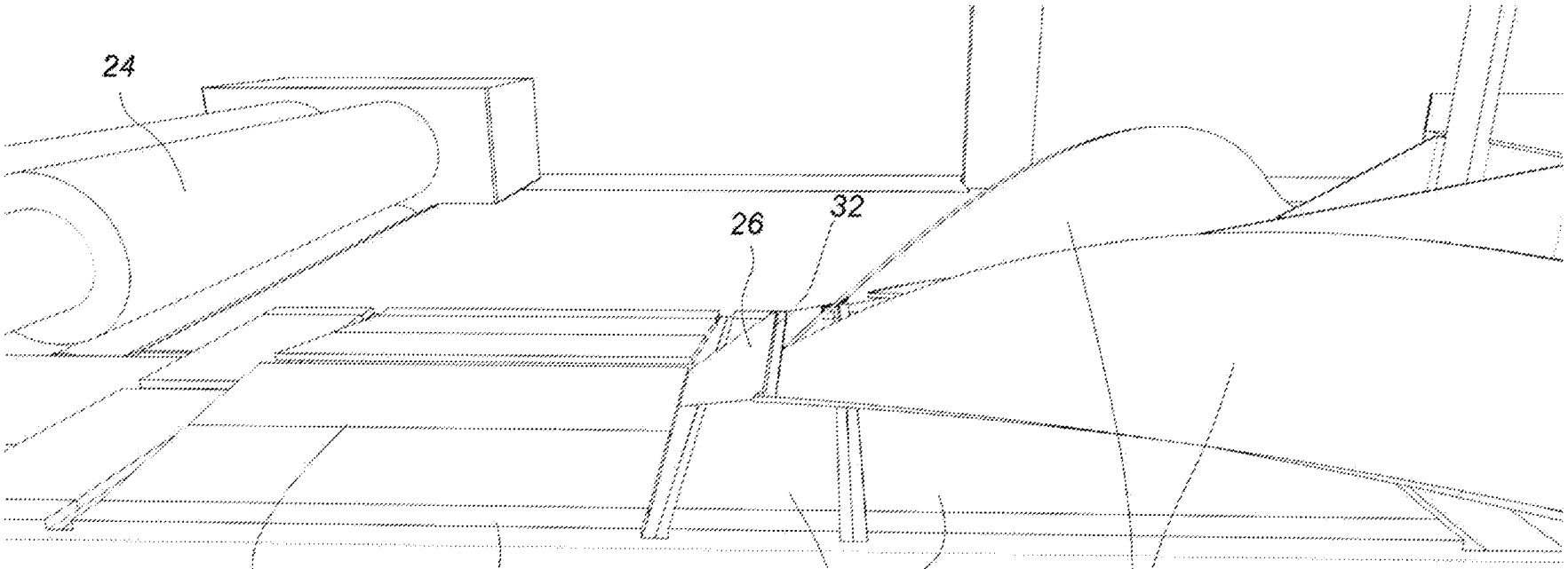
Figure 5:
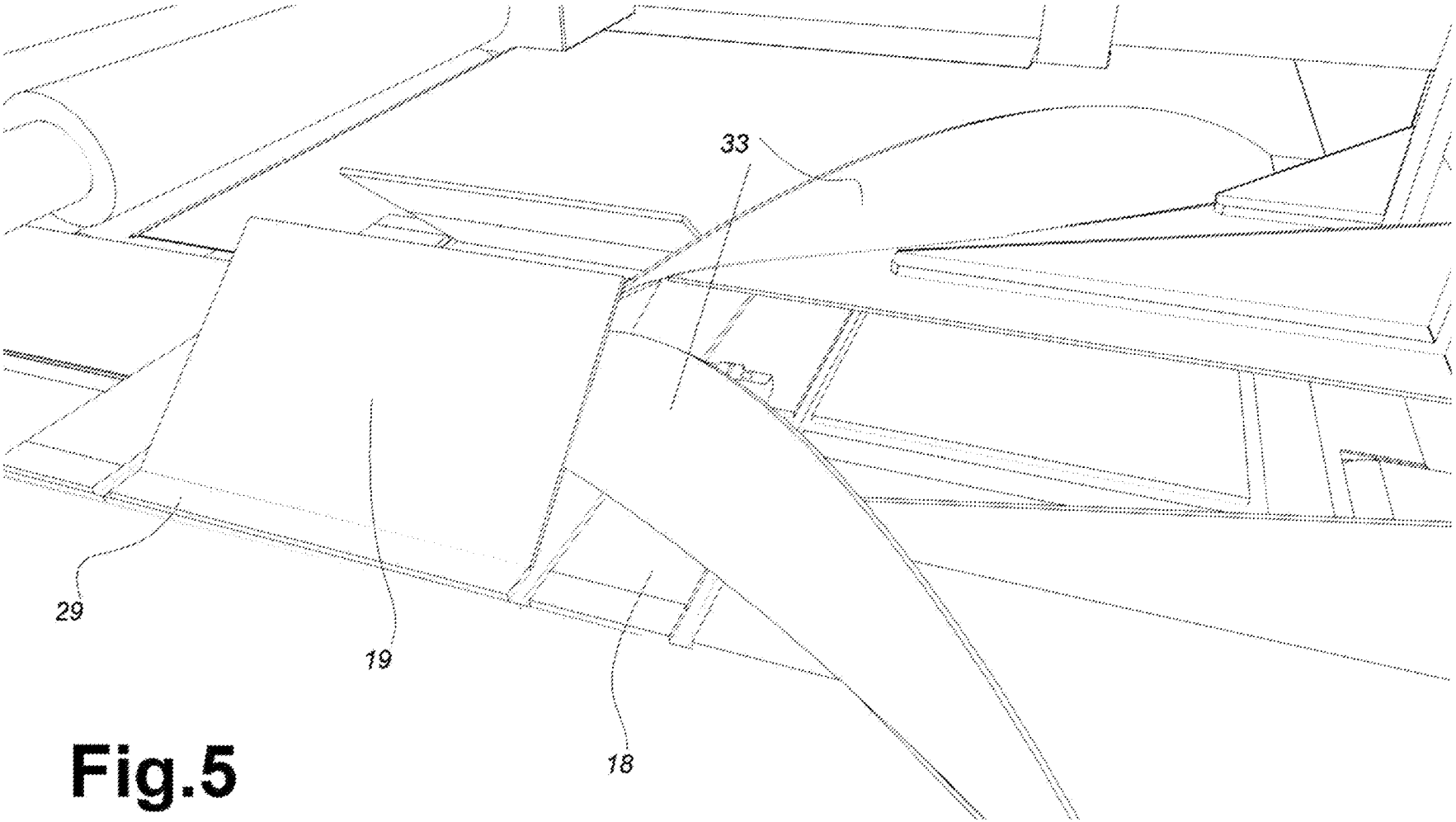
Figure 6:
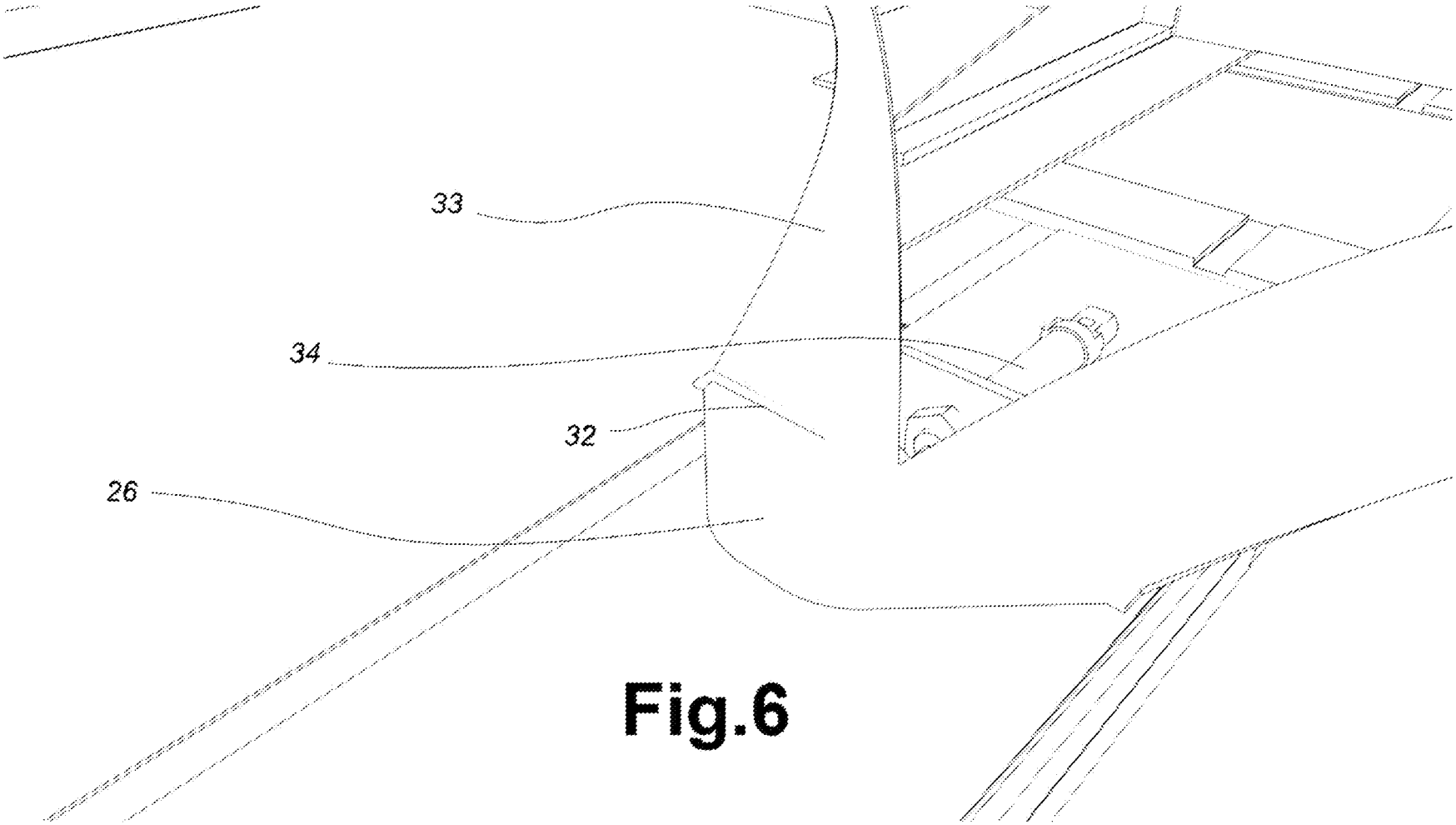

FIGS. 3, 4, and 5 show, schematically, a part of the machinery where the movable element is visible in various stages of the selective raising of two side flaps of the carton off the central portion and structures designed to complete the opening thereof;

FIG. 6 shows, schematically, a detail of the movable element in FIGS. 3 to 5.

Figure 1:
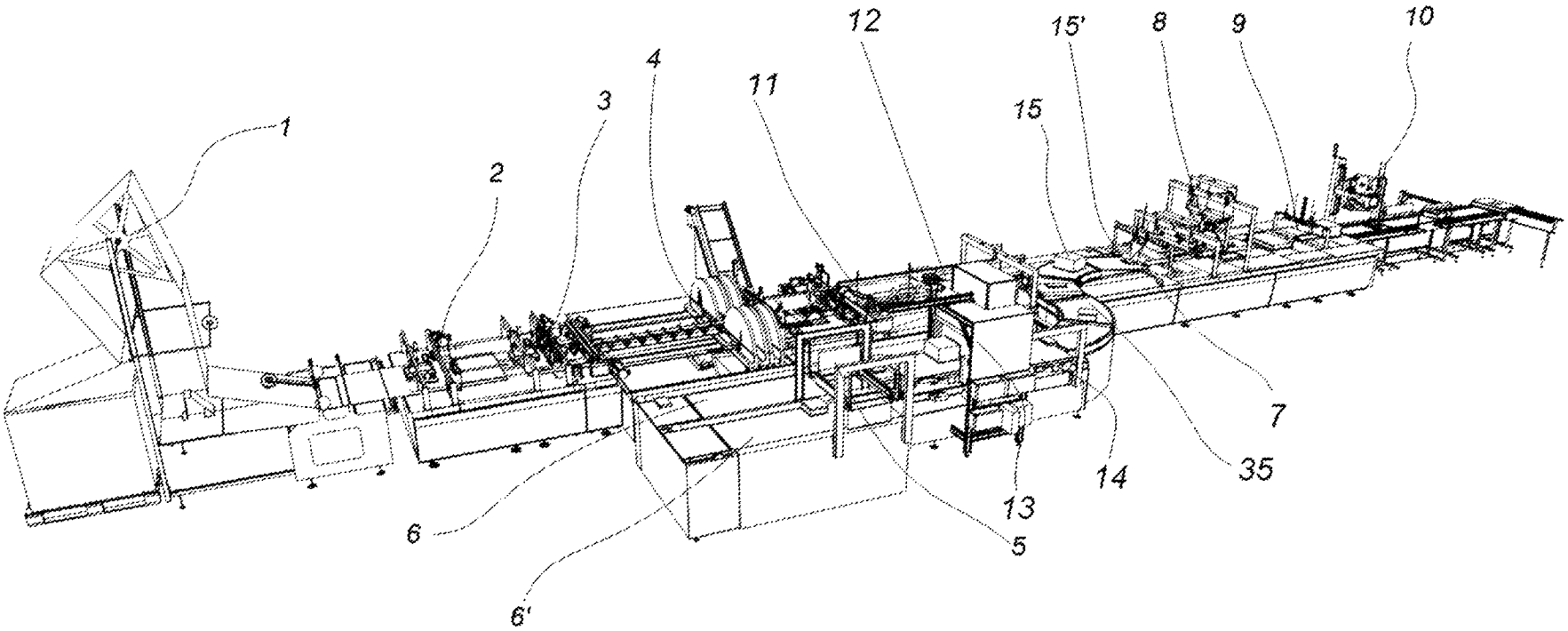
FIG. 1 shows, schematically, a perspective view of a machine for the formation of cartons and for the packaging of articles, according to the present invention, as a whole.

A machine according to the invention is shown in FIG. 1.

In this machine, a cardboard web 1 is fed by commonly known means, as a reel or fan-folded or made in another suitable way, for example as described in applications EP 3 529 050 or IT 102018000009606. A first cutting station 2 separates a rectangular portion from the web, for the creation of a carton following further formation steps. The carton proceeds on a suitable conveyor (of a commonly known kind) and reaches a creasing station 3 designed to create suitable creases, both longitudinally and transversely to the carton feed direction. A second cutting station 4 is designed to perform a series of notches. According to a preferred aspect of the invention, the said cutting station may be made, for example, according to the teachings of EP 3 464 073 A1. According to a further aspect, this solution may be modified by doubling the number of cutting units. In this way, the transversal cuts, on the transversal creases of the carton produced according to this document, could be made in a single step instead of two, eliminating the need to slow down or stop the carton during the formation thereof. Obviously, it should be made possible to space the various cutting units at the same time in a suitable way, so that they are positioned over the creases at the same time.

This is followed by a gluing station 11, where the glue is applied in a suitable position. Next follows a folding station 12, which comprises the components described above and will be described in detail below. The carton reaches position 7, where the article to be packaged 15, 15' is placed with the reinforcement panels glued onto the central portion and the side closing flaps open, to allow placement of the article.

The article can arrive from a loading station comprising one or more loading belts 6, 6', onto which articles can be loaded by operators. In the case exemplified, there are two loading belts. The articles on the second belt are pushed by suitable means 5 onto the first belt, alternating them with those loaded directly onto the first belt. A measuring structure 13 measures the position and dimensions of the article. This data is used to size the carton according to the dimensions of the article. An alignment system 14 appropriately centres the article, which moves onto a conveyor belt 35 that places it on the preformed carton at point 7. The loading and placement of the article can also take place in another commonly known way.

After the article has been placed on the carton, the carton reaches a further folding and gluing station 8 and a final closing station 9. The latter may be made as in EP 3 464 074 B1. According to a still further aspect, the closing station may be produced on a mobile undercarriage, equipped with a conveyor belt. This way, the mobile undercarriage allows the closing station to process the article and the carton with them stationary in relation to the station, without—however—stopping the motion of the article and carton on the machine's conveyor.

Further processing stations 10 may follow, for example for labelling.

The carton, as said, can be made, for example, as described in EP 3 093 246 A1. However, the machinery and the method according to the present invention are not limited to application solely to this type of carton, but can also be used with other types of carton that have suitable characteristics.

Figure 2:
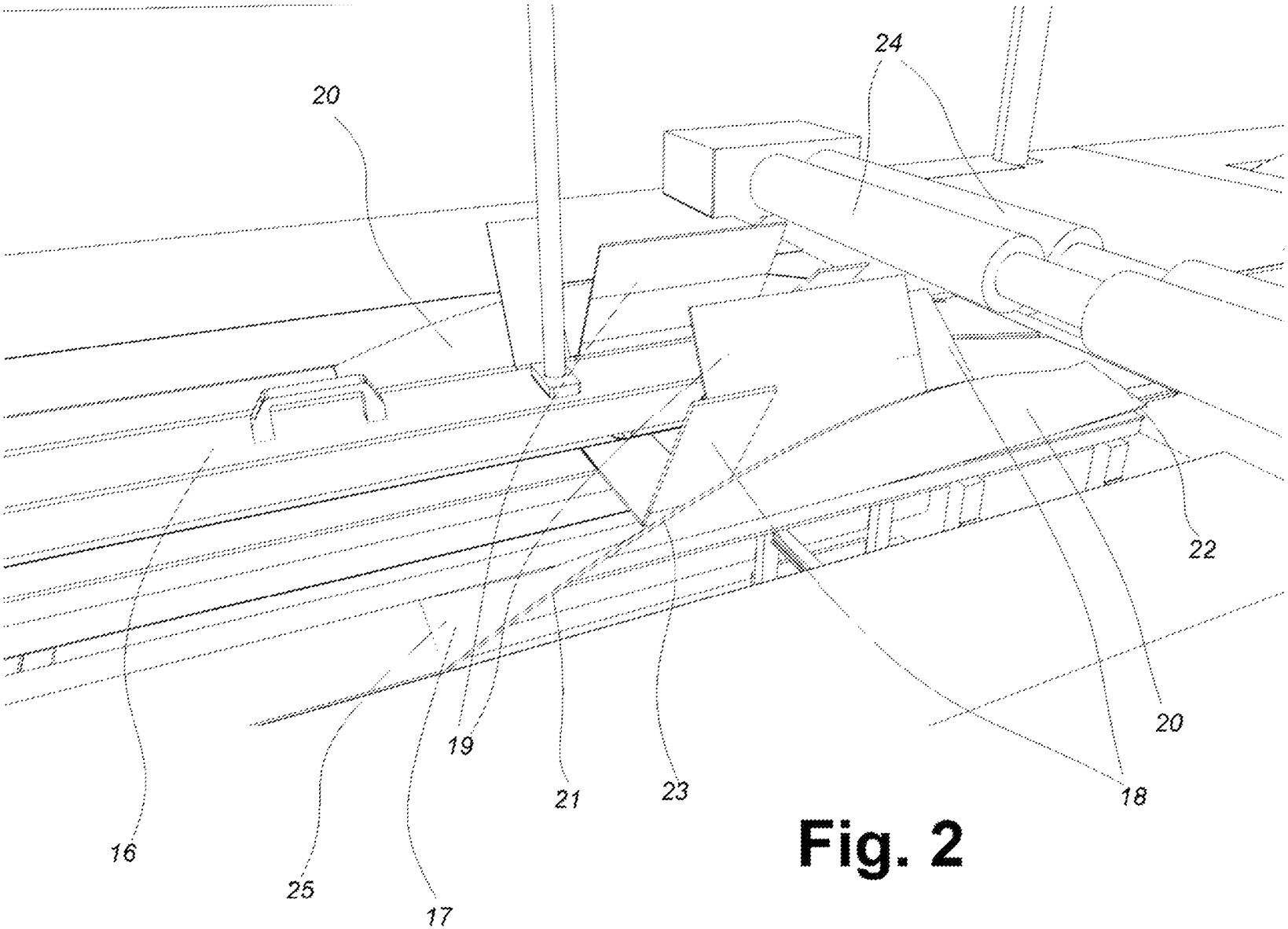
FIG. 2 shows, schematically, a part of the machine where the folding means are visible with a carton being folded.

With reference to FIG. 2, one can observe a carton 17 moved by a suitable conveyor (of a commonly known type), for example a conveyor belt located underneath the carton, which moves it by friction. In this section, there is also a system 16 (also commonly known) for holding the carton in position on the conveyor belt, which may comprise, for example, another belt that secures the carton between itself and the conveyor belt. It presses on the central portion 25 of the carton and stops at a suitable point to leave room for other systems that cooperate with the conveyor belt and allow closure of the side flaps 18 or panels 19. The folding means may comprise one or more movable section bars 20. These can move transversely to the carton feed direction and are designed to be moved according to the dimensions of the carton, in particular the position of the longitudinal creases that separate the flaps and/or side panels from the central portion 25, which are made, each time, according to the dimensions of the article to package, measured as stated above.

These means may be section bars (essentially belt-shaped) with a helical course 20. A first end 21 is essentially vertical and the height of the upper edge 23 increases in the carton feed direction and is designed to be positioned so that the side flaps and panels thereof can run thereover. The edge 23 also extends below the surface along which the carton travels to allow the panels or panels or flaps to engage with the lower edge without joints. The cross section of the section bar features a sufficient rotation up to the second end 22, in particular an essentially 90° rotation. This way, the second end is arranged parallel to the surface on which the carton travels. The rotation from the first to the second end is towards the carton, the same direction as the folding of the panels or flaps. The torsion is such that, by suitably positioning the profile, the first end 21 is in correspondence with the passage of the open side panels or flaps, while the second 22 is positioned above the area where the central portion with the closed panels or flaps travels. Therefore, as can be easily deduced, by positioning the edge 23 in proximity (externally) to the longitudinal creases on the carton around which the panels or flaps must rotate, the mere feeding of the carton causes the engagement of the flaps or panels with the section bar, causing the closure onto the central portion. After the folding means, the machine preferably features pressing means, such as the rollers 24, designed to compressing the panels or flaps and promote gluing where the glue has been previously applied, for example, for the case in question, at the same points of the carton as in EP 3 464 085 A1, or where appropriate according to the shape of the carton.

The carton continues to travel, moving towards a device for the selective reopening of part of the side flaps or panels.

With reference to FIGS. 3, 4, and 5, the device comprises a movable element 26 which moves between a first position, as shown in FIG. 3, and a second position, as shown in FIGS. 4 and 5.

In the first position it does not interfere with the carton 17 during the passage thereof. In the second, it is designed to engage the side flaps or panels 19. It is designed to assume the second position when the carton reaches a position in which an edge 27 of the flaps or panels to be raised is located where the end 28 of the movable element 26 is in the second position. This way, the movable element is designed to slip, due to the movement of the carton, between the central portion 25 and the flaps or panels 19 to be raised, as seen in the series of FIGS. 3, 4, and 5. The movable element is preferably tongue-shaped, with a rounded end 28, so as not to damage the carton. According to the exemplified aspect of the invention, the closing flaps 19 to be raised are not glued to the central portion, while, according to one aspect of the invention, the folding flaps 29 are, the said flaps being delimited by the longitudinal creases 30 around which they are folded onto the central portion and a second longitudinal crease 31 around which the closing wings 19 are hinged, which are the only ones which move upwards. According to one aspect of the invention, the movable element 26 can rotate around a hinge 32 between the two aforesaid positions. The element is designed to return to the first position at the appropriate time, so as not to interfere with the carton after raising, in particular not to interfere with the flaps 18 which must not be raised. The device can be completed with the shaped surfaces 33, which have one end at the hinge 3 and branch off from the movable element. They may feature an outwards torsion and may extend by a sufficient amount to make the panels or flaps open sufficiently for the subsequent processing steps, almost completely if necessary. The torsion can be enough to allow the operation to be carried out without damaging the cartons, adapting to all possible machine dimensions.

For the movement of the movable element, means can be used that can be easily designed by a person skilled in the art. For example, FIG. 6 shows a cylinder 34, which may feature hydraulic, pneumatic, or solenoid operation, designed to move the movable element.

Other solutions are possible, for example the whole device may be displaced vertically or may be rotatable towards the route of the cartons. The solution exemplified minimises the parts to be handled and allows a formation which does not involve the carton stopping at any time, therefore speeding up operations.

The invention claimed is:

1. A carton assembly machine for cartons for packing articles, comprising:

means for making a pre-formed carton to proceed in a progress direction, the said carton having a plurality of side flaps or panels folded along folds which are essentially parallel to the said progress direction, on a central portion of the carton;

a movable element designed to move between a first position away from the route of the carton and a second position in which the said element is designed to be inserted underneath at an edge of at least one of said side flaps or panels, so that the latter is raised with respect to the said central portion in cooperation with the carton progress; and folding means designed to fold a plurality of flaps or panels hinged by means of suitable longitudinal creases onto the said central portion, before one of the said flaps or panels are raised with respect to the central portion by the movable element, wherein the said folding means are section bars arranged longitudinally along the route of the carton and may be moved in a direction perpendicular to the said route, having a first end facing the direction of origin of the carton, with a rounded corner and arranged vertically to fit under the said flaps or panels, and a second end arranged parallel to the surface onto which the carton can be placed and above the said surface, the said section bars featuring, between the two ends, a twisting cross section.

2. The machine according to claim 1, wherein the movable element is designed to return to the first position to avoid unnecessary contact with the carton, which avoids coming into contact with a plurality of side flaps and/or panels which must not be raised.

3. The machine according to claim 1, including pressing means to promote the gluing of at least part of the said flaps or panels onto the central portion, interposed between the folding means and the movable element.

4. The machine according to claim 1, wherein the said movable element has a rounded end and can be rotated around a hinge which is arranged essentially parallel to the surface on the top of which the carton can be placed.

5. The machinery according to claim 4, comprising two shaped surfaces which extend from the said hinge, diverging along the carton feed direction.

6. A packaging carton assembly method, the method comprising:

folding, using the carton assembly machine according to claim 1, of a plurality of side flaps and/or panels over a central portion of a carton; and selectively reopening of part of the said flaps or panels.

7. The method according to claim 6, further comprising:

progressing of a carton with the flaps and/or panels folded over the central portion;

moving of a movable element from a first position, in which the said element does not interfere with the carton, to a second position, in which one end of the movable element can be inserted under an edge of one or more of the said flaps and/or panels, when the carton has reached a position in which the said end can meet the said edge when the movable element is in the second position;

raising of the said flaps or panels; and moving of the movable element into the first position before meeting other flaps and/or panels during carton progress.

* * * * *